US007823229B2

(12) United States Patent
O'Brien et al.

(10) Patent No.: US 7,823,229 B2
(45) Date of Patent: Nov. 2, 2010

(54) PIVOTING AND LOCKING WALL MOUNTED SUPPORT RAIL FOR ELDERLY AND DISABLED PERSONS

(76) Inventors: John L. O'Brien, 11 Park Lane Court, Ottawa, ON (CA) K1B 3N3; Edward Martin Thomas, P.O. Box 131, Russell, Ontario (CA) K4R 1C8; Donald Andrew Ed, 27 Oentes Lane, Ottawa, Ontario (CA) K1S 0X1

( * ) Notice: Subject to any disclaimer, the term of this patent is extended or adjusted under 35 U.S.C. 154(b) by 851 days.

(21) Appl. No.: 11/589,827

(22) Filed: Oct. 31, 2006

(65) Prior Publication Data

US 2008/0098510 A1 May 1, 2008

(51) Int. Cl.
*A47K 3/024* (2006.01)

(52) U.S. Cl. ..... 4/576.1; 4/573.1; 4/589

(58) Field of Classification Search ..... 4/576.1, 4/573.1, 248, 691, 589, 584, 562.1, 560.1, 4/561.1, 564.1, 565.1; 119/840; 16/126, 16/412; 248/118, 691, 602, 541, 220.21, 248/276.1, 205.1, 200; 5/646, 630, 136, 5/84.1, 662; 280/302, 301, 762
See application file for complete search history.

(56) References Cited

U.S. PATENT DOCUMENTS 4,932,090 A * 6/1990 Johansson ..... 5/662
5,586,352 A * 12/1996 O'Brien et al. ..... 5/662

* cited by examiner

*Primary Examiner*—Khoa D Huynh
*Assistant Examiner*—Lauren Heitzer

(57) ABSTRACT

A wall mounted pivoting and locking support rail assembly providing improved support to assist elderly and physically challenged persons with safely using a bathtub or shower area. The present invention mounts to the wall in a similar way to a conventional grab bar, however, it adds an additional rail handle with the ability to pivot outward from the wall, and lock in one of several angular positions to extend support outward from the wall, and more to the centre of a shower or tub. This outward support is invaluable to assist with elderly and disabled persons to safely enter, use, and exit from the bathtub without dangerous reaching.

9 Claims, 8 Drawing Sheets

PIVOTING AND LOCKING WALL MOUNTED SUPPORT RAIL FOR ELDERLY AND DISABLED PERSONS

BACKGROUND

1. Field of Invention

Figure 1:
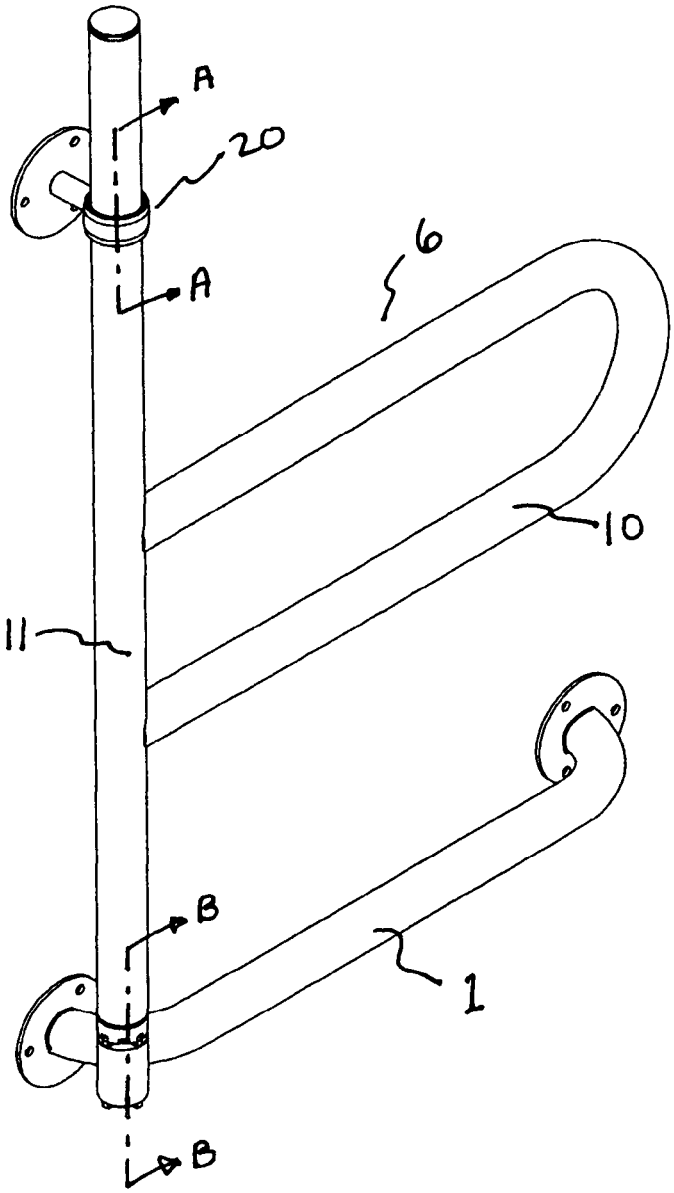

This invention relates to a pivoting and locking wall mounted support rail assembly which improves support to assist elderly and disabled persons while entering into, moving within, or exiting from a bathtub or shower area.

2. Description of Prior Art

Entering and moving safely within a typical bathtub area may be a difficult process for some elderly and disabled persons. Particularly, traversing the bath tub outer threshold can cause a loss of balance Use of a bathtub requires several tasks that require balance, namely, entering the bathtub and stepping over the tub's outer wall, maintaining stability while standing in the tub, working the shower controls, balancing while using the hand shower, lowering to a seated position on a bath board or shower seat, raising to a standing position from the bath board or shower seat, lowering to sit on the floor of the tub, and subsequently regain a standing position. This all occurs in an area that is wet, slippery, and typically without assistance, or well located hand rail support.

There are numerous prior art devices to assist with bathtub mobility and safety. These include; wall mounted grab bars, tub side mounted support rails, floor to ceiling poles alongside the tub, bath sitting boards, shower seats, and transfer benches.

There are numerous issues with the current devices:

Wall mounted grab bars typically force a user entering the tub to reach across to the grab bar on the far wall—This reaching can cause a loss of balance before the support is at hand. When in the bathtub, the user must twist to the side to keep the support at hand. This takes away the use of one or both hands to maintain balance while the hands are needed for tasks such as washing, adjusting water controls, etc Tub side mounted support rails are typically a little low in height to be of value, are not always secure, and can prevent the use of shower curtain or rigid shower doors Floor to ceiling poles mounted alongside the tub can assist with entry, and mobility to start a bath, however, they are not available when the shower curtain or doors are closed.

Bath sitting boards and shower seats do not help while the user is standing, and are bulky, and cumbersome to remove for additional persons using the bathtub or shower who do not need these devices. Furthermore, they are not secured in their position, and as a result can move at the instant when secure support is required.

None of the above prior art devices allow the user to lean forward on the support while adjusting the shower controls. None have the ability to easily move the hand rail support to where it is optimal, and move it again when it may be in the way for the next manoeuvre, or the next occupant. Further, many of the above devices have handrail support at only one height, which may not be optimal for all movement tasks.

Clearly, the present devices do not address full safety of the user of a bath or shower area.

SUMMARY OF THE PREFERRED EMBODIMENT

Turning now to the present invention, it has a pivoting and locking movable handrail that locks in numerous angular positions to provide optimal support for different activities in the bathtub—i.e. showering, adjusting controls, seating, entering, exiting.

When the pivoting rail is swung out, it places support in the middle of the tub that permits both vertical and lateral loads. This permits users to lean on the rail for balance, and where appropriate, have more free use of their hands.

The pivoting and locking rail locks and unlocks easily—lift the pivot rail assembly to unlock it, holt it up to rotate it freely, and lower at any time to find the nearest angular locking position.

The pivoting rail stores out of the way along the wall when not in use to permit full enjoyment of the bathtub by other users not needing such support.

The complete system has three height levels of support to help with low tasks such as lowering down to sit on the floor of the tub, to mid level activities, such as transitional phase of standing up from a seating position, to high activities such as standing support.

The advantageous three point securement to the wall ensures that the rail will not get loose with time as might happen with two point securement The angular locking feature is fully able to handle shower water on it and through it without consequence.

The ambidextrous nature of the locking feature permits installation in both directions—with pivot rail vertical tube on the left or the right side.

The top pivot collar assembly had dual tapered bore feature that allows for uneven walls and slight angular installation errors.

The guide sleeve inside the top pivot collar prevents wear marks on vertical member pivot tube of pivot rail assembly and dampens lateral sliding sounds.

The system attaches to wall using known methods.

Other objects, features and versions of the present invention will become apparent from the following detailed description which, when interpreted with the listed drawings together disclose a preferred embodiment of the invention. It is to be understood that the drawings are intended for the purpose of illustration only, and are not intended as a definition of the limits of the invention.

BRIEF DESCRIPTION OF THE DRAWINGS (8 DRAWING SHEETS ATTACHED, 10 FIGURES)

Figure 2:
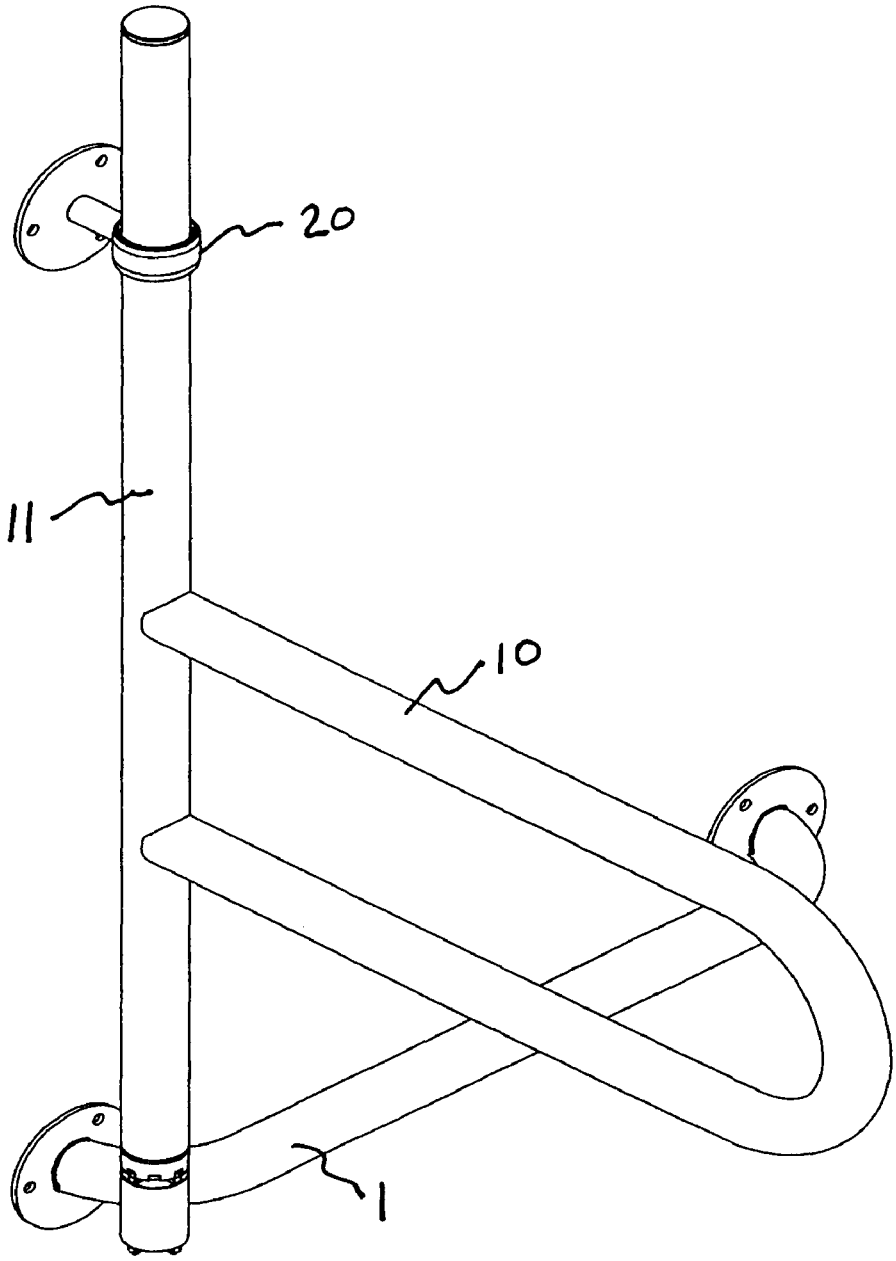
Figure 3:
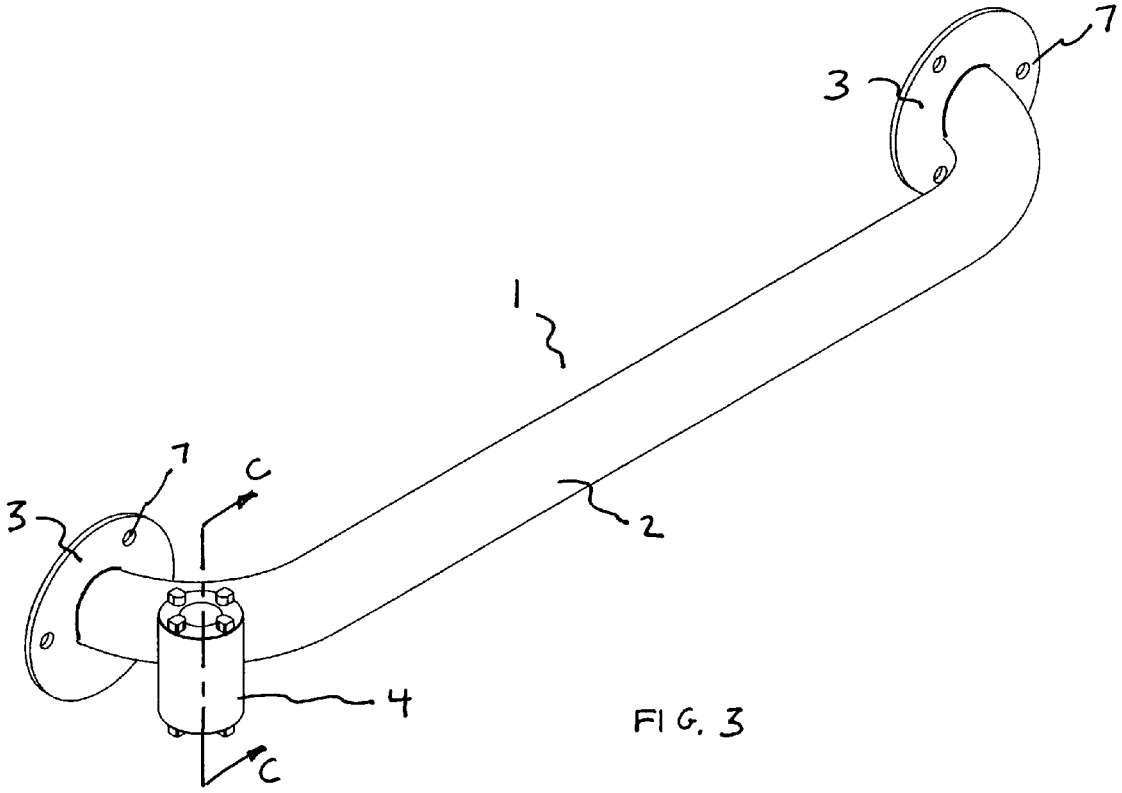
Figure 4:
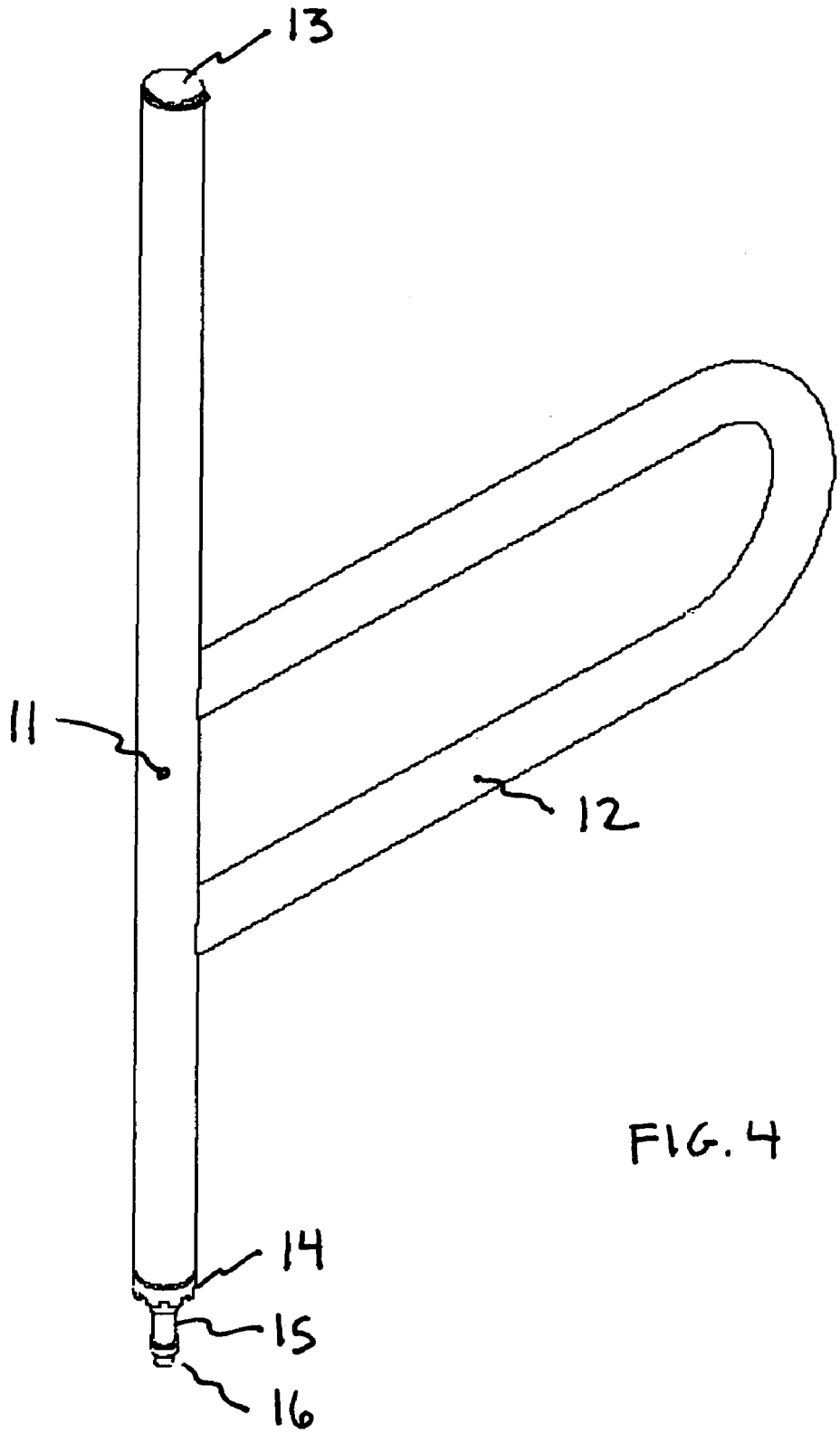
Figure 5:
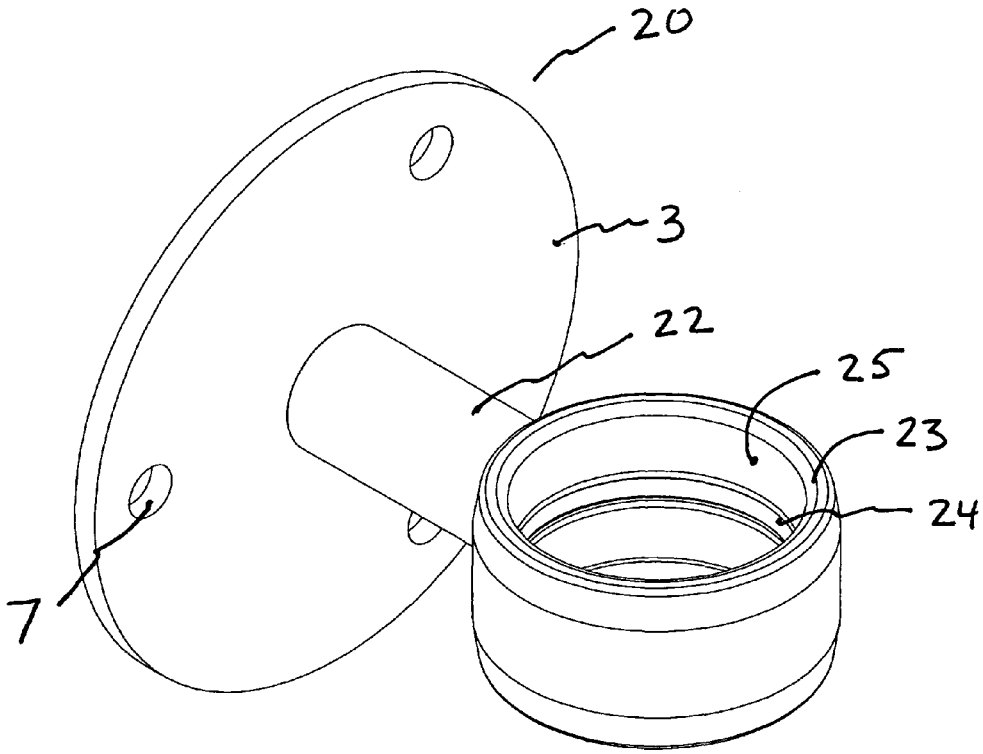
Figure 6:
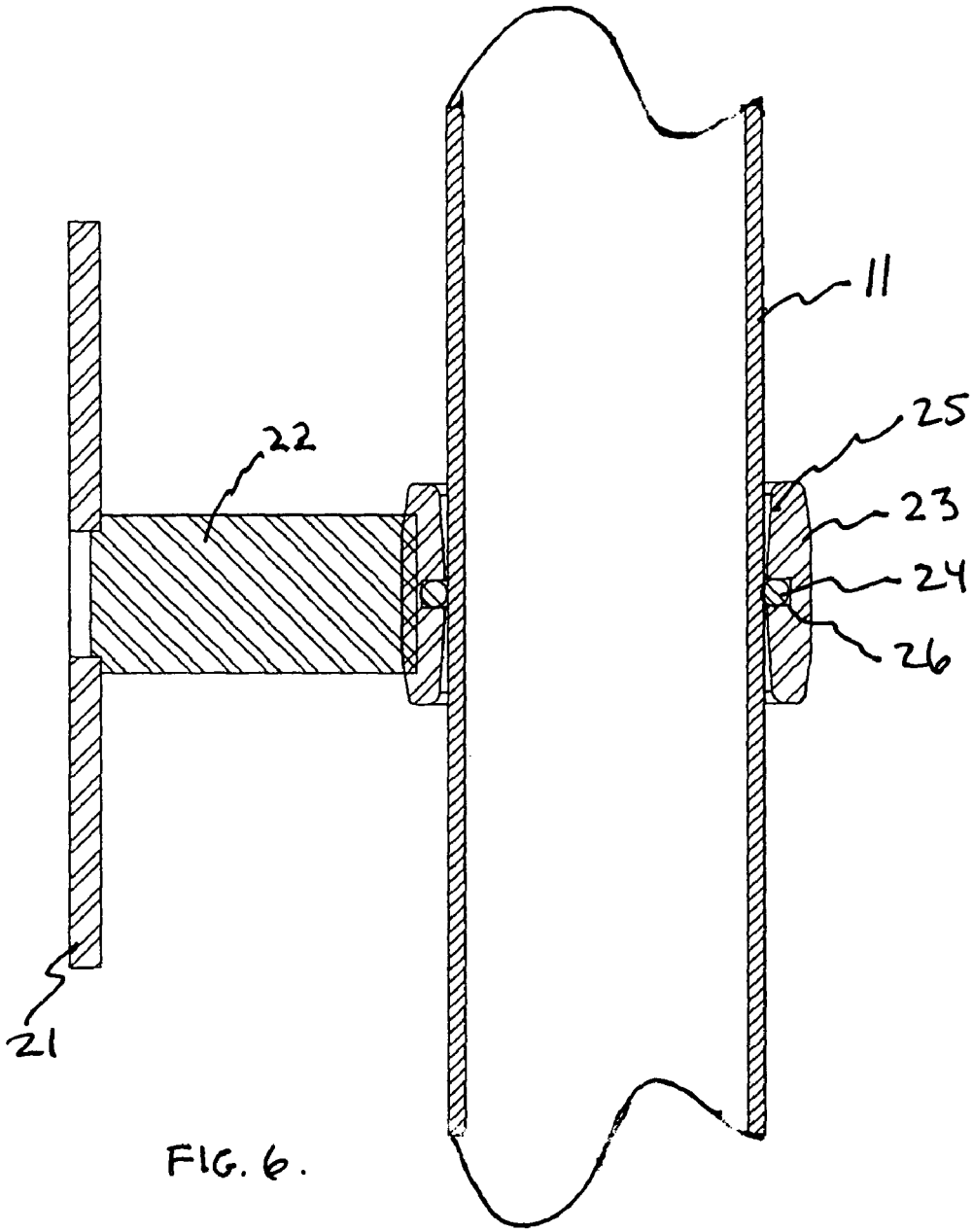
Figure 7:
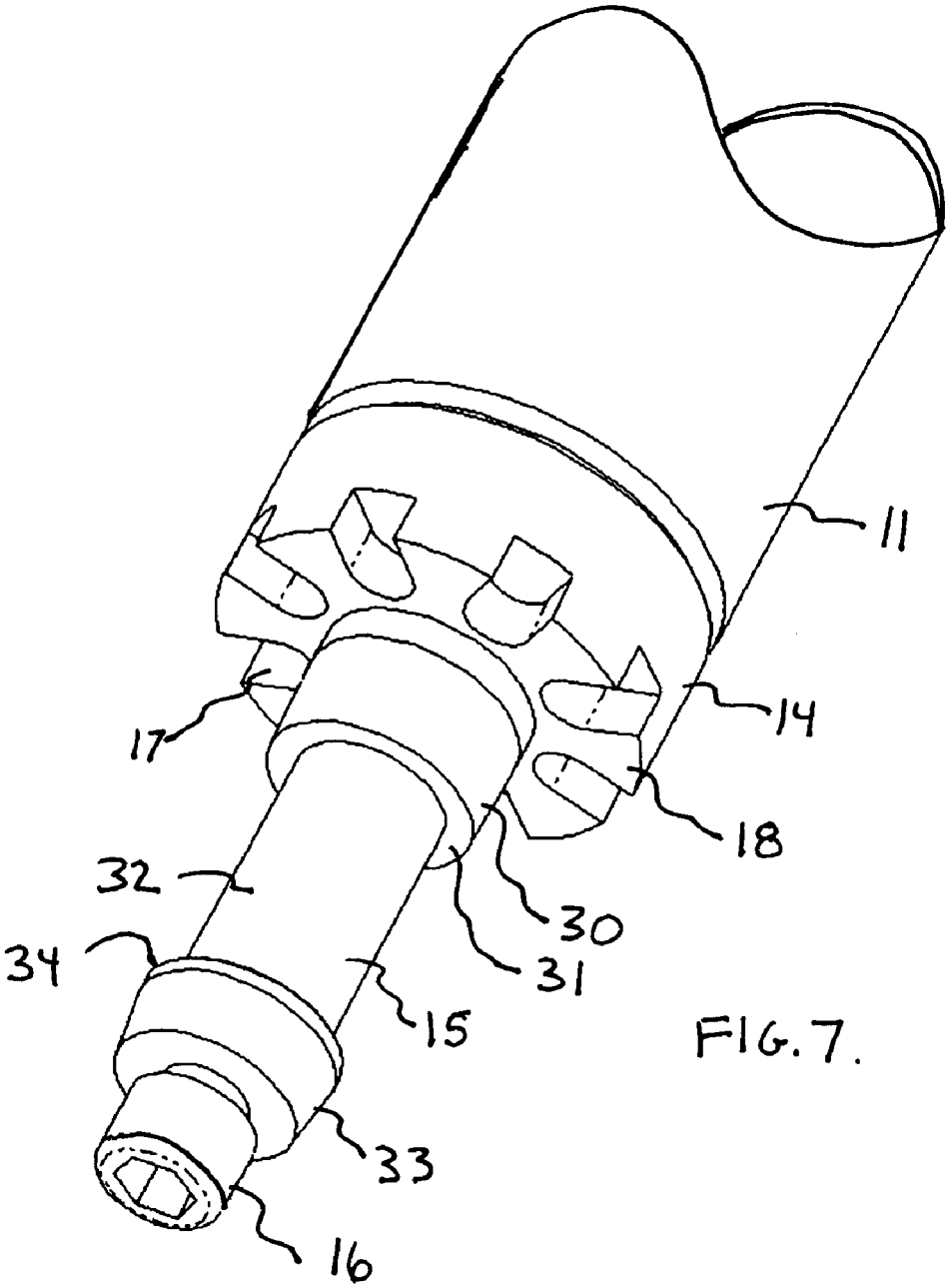
Figure 8:
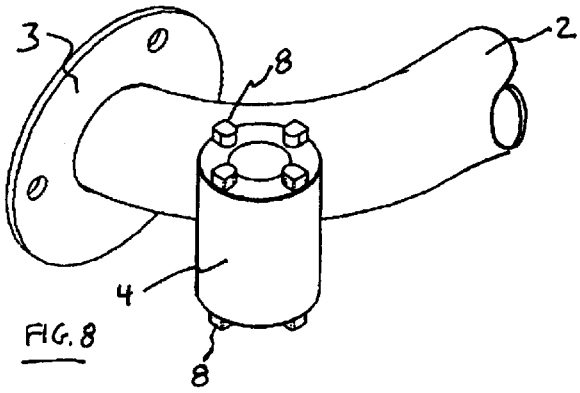
Figure 9:
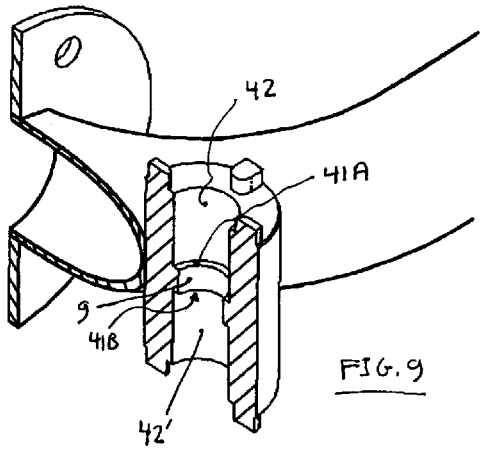
Figure 10:
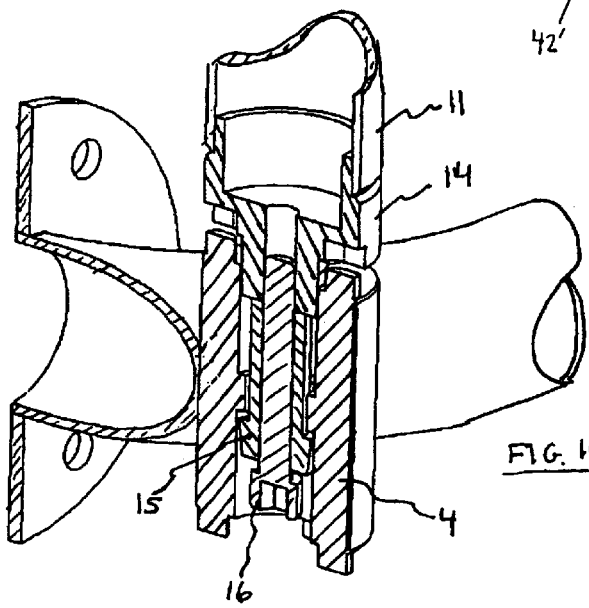

FIG. 1 is a perspective view of one embodiment of the present invention as would be mounted on a wall, with the pivot rail assembly in the "stored along wall" angular position FIG. 2 is a perspective view of one embodiment of the present invention as would be mounted on a wall, with the pivot rail assembly in the "90 degree pivoted outward" angular position FIG. 3 is a perspective view of the lower wall mounting member FIG. 4 is a perspective view of the pivot rail assembly FIG. 5 is a perspective view of the pivot collar assembly FIG. 6 is a partial section view "A-A" of a portion of the pivot rail assembly as held within the pivot collar assembly FIG. 7 is a partial perspective view of the bottom of the pivot rail assembly FIG. 8 is a partial perspective view of the lower wall mounting member FIG. 9 is a partial perspective/section view "C-C" of the lower wall mounting member FIG. 10 is a partial perspective/section view "B-B" of the main assembly

DETAILED DESCRIPTION OF THE PREFERRED EMBODIMENT

Referring now the figures, FIG. 1 illustrates one embodiment of the present invention showing the movable handrail 6, as a complete system, as it would be installed on a typical wall, such as the long wall alongside a bathtub.

The main assembly of the movable handrail 6, comprises three major components, namely, the lower wall mounting member 1, the pivot rail assembly, 10, and the pivot collar assembly 20. These three major components are combined in place, secured on a wall surface to achieve the working main assembly.

FIG. 1 shows the pivot rail assembly 10, located in its rotational position for storing the pivot rail assembly 10 alongside the wall. This position is advantageous both for storing the pivot rail assembly 10, out of the way along the wall, as well as, for actual use of the pivot rail assembly 10 in this position, to benefit from the higher gripping levels of the pivot rail assembly 10.

By comparison, FIG. 2 shows the pivot rail assembly 10, in one of the available locked rotational positions whereby the pivot rail assembly 10, is situated at approximately 90 degrees outward from the wall. The pivot rail assembly 10, as described in the preferred embodiment, is also able to pivot and lock at additional angular positions, including 45, 135 and 180 degrees to the wall. Additional in-between locking angular positions could be achieved by modification to the preferred embodiment by those skilled in the art. The mechanism for locking is described later in this text.

The illustrated embodiment in FIG. 2 shows the vertical member 11, of the pivot rail assembly 10, supported above the left side of the lower wall mounting member 1. Alternatively, it should be noted that the ambidextrous design of the lower wall mounting member 1, is such that it will permit the system to have the vertical member 11, of the pivot rail assembly 10, supported above the right side of the lower wall mounting member 1, by inverting the lower wall mounting member 1, as is described further on in this text.

Turning now to better describe the major sub assemblies, FIG. 3 shows the lower wall mounting member 1, which comprises two wall mount members 3, fastened onto ends of lateral member 2, such that lateral member 2 is held essentially parallel to a wall when installed. Wall mount members 3, have apertures 7, through which fasteners (not shown) may be installed to secure the lower wall mounting member 1, to a wall. Lower pivot 4 is secured within a mating notch in the outer surface of lateral member 2 by permanent means such as welding, adhesive, or fasteners. It is located such that its central vertical axis intersects with the central horizontal axes of the lateral member 2, wall mount member 3.

The elements of wall mount member 1, may be constructed of a strong corrosion resistant material such as high strength reinforced plastic, or more favourably, steel with a corrosion resistant finish, or an aluminum alloy, or most favourably, stainless steel, which is both strong, and corrosion resistant through it's entire depth, even in moving mating areas where a protective surface finish may wear off over time Continuing with major assemblies, FIG. 4 shows the pivot rail assembly 10, which comprises tubular member construction of arm member 12 which is permanently fastened onto vertical member 11 by permanent means such as welding, adhesive or fasteners (not shown). The arm member 12 provides strength due to it's closed loop design, however alternative embodiments such as a wider "D" shape, "B" shape or other profiles could be attached to the vertical member 11. The cross section of the u-rail could favourably be circular, oval, or oblong. A lower end 14, is located coaxially within the bottom end of the vertical member 11, and secured by means such as welding, adhesive or fasteners (not shown). An axial projection 15 is held in place coaxially to the lower end 14 central axis to the bottom end of the lower end 14, by means of a screw 16. The top end of the vertical member 11 is sealed by means of the top cap 13, which forms a liquid and vapour tight seal which is important in a bathtub and shower environment. Top cap 13 may be fabricated from a lightweight corrosion resistant material such as plastic. The elements of pivot rail assembly 10, may be constructed of a strong corrosion resistant material such as high strength reinforced plastic, or more favourably, steel with a corrosion resistant finish, or an aluminum alloy, or most favourably, stainless steel, which is both strong, and corrosion resistant, even in moving mating areas where a protective surface finish may wear off over time The final major assembly, shown in FIG. 5, is the pivot collar assembly 20. It comprises annular upper pivot 23, which is held by and attached to spacer 22 which is attached to wall mount member 21 by permanent means such as welding or fasteners (not shown). Wall mount member 3 has apertures 7 to permit screws to mount the pivot collar assembly 20 to a wall. The pivot collar assembly 20 is most favourably fabricated from a corrosion resistant material such as plastic or stainless steel. In the case of stainless steel, the inner bore 25 of annular upper pivot 23 may be lined with a guide sleeve 24 to provide a more resilient surface to interface with the outside surface of the vertical member 11 (not shown) of the pivot rail assembly 10 (not shown)

FIG. 6 better illustrates the makeup of the pivot collar assembly 20, by means of a section view "A-A". Vertical member 11 is held coaxially within the bore of annular upper pivot 23. Guide sleeve 24 may be held by a press fit, or within a groove 26 within the bore of annular upper pivot 23. There is advantageously a small amount of diametrical clearance between the outside diameter of vertical member 11, and the inside diameter of guide sleeve 24 to permit to permit free rotational pivoting, as well as free up and down axial motion of vertical member 11 within the pivot collar assembly 20. Advantageously, the inner bore 25 surface is tapered somewhat outward in each direction from the middle of the inner bore 25. This permits the pivot collar assembly 20 to accommodate some degree of angular error of installation, yet still maintain free motion of vertical member 11.

Moving now to the method of pivot and locking, FIG. 7 is a partial perspective view of the lower end 14 of the pivot rail assembly 10. The lower end 14 is shown situated in the bottom of vertical member 11, and secured with permanent means such as welding. The lower end 14, has a plurality of grooves 17, which are spaced at equal angles about the bottom shoulder face 18 of the lower end 14. A tapered stem 30 further protrudes from the bottom shoulder face 18 of the lower end 14. The bottom surface 31 of the lower end 14 has a centrally located aperture (not shown) that is threaded to receive screw 16.

Axial projection 15 has a first diameter member 32, and distal second diameter member 33, that provides shoulder 34. The axial projection 15 has an aperture (not shown) coaxially located through its entire length, to permit the clearance passage of the screw 16.

Moving now to FIG. 8, this shows a partial perspective view of the lower pivot 4 on the lower wall mounting member 1. FIG. 8 shows a plurality of teeth 8, located on the top surface and the bottom surface of the lower pivot 4 arranged in a circular pattern in with equal angles between them. The presence of a plurality of teeth 8, located on the top and bottom surface of the lower pivot 4, permits the lower wall mounting member 1 to be used with the lower pivot 4 located on the left or the right side as most advantageous for the particular need of the user.

FIG. 9 shows a partial perspective section view "C-C" of the lower wall mounting member 1, with the section cut through the middle of the lower pivot 4. From this view we can see the second diameter 42, the first diameter 9, and resulting shoulders 41A, and 41B.

FIG. 10 shows a partial perspective section view "B-B" of the locking interface between the bottom end of the pivot rail assembly 10 and the lower pivot 4.

Referring to FIGS. 7, 9 and 10, the pivot rail assembly 10 is installed into the lower pivot 4 by first removing the screw 16, of the axial projection 15, and setting the tapered stem 30, of the lower end 14, into the top second diameter 42 of the lower pivot 4. The first diameter member 32 of the axial projection 15 is then inserted up through the bottom of the lower pivot 4, and held in place against the bottom surface 31 of the tapered stem 30 of the lower end 14 by screw 16 engaging into threaded hole (not shown) of lower end 14.

The first diameter divides the wider second diameter into a top wider second diameter 42 and a bottom wider second diameter 42'.

The bottom end of the pivot rail assembly 10, is held coaxially within the lower pivot 4, by the tapered stem 30, centering itself within the second diameter 42 of the lower pivot 4, as well as the first diameter 32 of the axial projection 15 centering itself within the first diameter 9 of the lower pivot 4. This arrangement allows the pivot rail assembly 10 to rotate coaxially about the lower pivot 4, and move a limited amount of up and down axial motion within the lower pivot 4. When the pivot rail assembly 10 is allowed to move down, the plurality of teeth 8 of the lower pivot 4, will fit up inside of the plurality of grooves 17 of the lower end 14. This will prevent the pivot rail assembly 10 from pivoting, thereby locking the rotational position of the pivot rail assembly 10 relative to the lower pivot 4 on the lower wall mounting member 1. At this point the user may apply a lateral load or downward load to the pivot rail assembly 10, without it moving. The load force is taken by the plurality of teeth 8 of the lower pivot 4, and the pivot rail assembly 10, is also restrained at its top by the pivot collar assembly 20 which prevents lateral movement, yet permits axial movement when the user wishes to lift the pivot rail assembly 10, to unlock it.

In order to unlock the pivot rail assembly 10, to permit free rotation, the user must lift the pivot rail assembly 10 upward, thereby lifting the lower end 14 such that the plurality of teeth 8 of the lower pivot 4 are no longer in the plurality of grooves 17 of the lower end 14. At this point the pivot rail assembly 10 may be freely rotated coaxially about the lower pivot 4, and guided at the top by the pivot collar assembly 20. The pivot rail assembly 10, is prevented to lifting right out of the lower pivot 4, by the shoulder 34 of the axial projection 15 hitting against the shoulder 41 of the lower pivot 4.

Although the invention has been described relating to a preferred embodiment, it should be understood that various modifications, additions, and alterations may be made to the invention by one skilled in the art without departing from the spirit and scope of the invention as defined in the appended claims.

What is claimed is:

1. A pivotal handrail, attached to a wall or a vertical surface comprising:

a vertical member movable about an axis including:

a lower end having a plurality of grooves disposed along a circumference and directed along an axis parallel to said vertical member axis, and an axial projection including a first diameter member and a distal second diameter member larger than said first diameter member;

an arm member radially having at least one bend therein formed to attach said vertical member at least two places therealong;

a lower pivot having a first portion mounted to a lower wall mounting member, said lower pivot including a plurality of teeth disposed on a first surface along a circumference and directed along an axis substantially parallel to said vertical member axis and aligned to mate with said vertical member grooves, an aperture therein including two diameters, comprising a first diameter and a relatively wider second diameter, where in said first diameter divides said wider second diameter into a top wider second diameter and a bottom wider second diameter, wherein, when assembled, said vertical member distal second diameter member is passed through said top wider second diameter and disposed within said bottom wider second diameter.

2. The handrail of claim 1, wherein said vertical member distal second diameter member comprises a second diameter member adapted to be retained by said lower pivot said first diameter aperture.

3. The handrail of claim 2, wherein said vertical member distal second diameter member includes an aperture therein, said handrail further including a screw disposed in said vertical member distal second diameter member.

4. The handrail of claim 1, further including an annular upper pivot substantially surrounding said vertical member, which together with said lower pivot, define a direction of said vertical member axis.

5. The handrail of claim 4, wherein said annular upper pivot includes a wall mount member to connect said annular upper pivot to said wall.

6. The handrail of claim 1, wherein said arm member comprises a tubular member.

7. The handrail of claim 6, wherein said tubular member comprises one of a "U", "D" and "P" shape.

8. The handrail of claim 1, further including a lateral member connected to said lower pivot disposed to extend away from said vertical member axis.

9. The handrail of claim 8, wherein said lateral member includes a wall mount member to connect said lateral member to said wall.

* * * * *